United States Patent [19]

Saito

[11] 4,170,803

[45] Oct. 16, 1979

[54] FLOOR SWEEPER HAVING A PIVOTABLE HANDLE

[75] Inventor: Gunsei Saito, Kashiwa, Japan

[73] Assignee: Hukuba Kogyo Kabushiki Kaisha, Chiba, Japan

[21] Appl. No.: 875,508

[22] Filed: Feb. 6, 1978

[30] Foreign Application Priority Data

Jan. 17, 1978 [JP] Japan ..... 53-3708[U]

[51] Int. Cl.[2] ..... A47L 13/11; B25G 3/38

[52] U.S. Cl. ..... 15/144 R; 15/42

[58] Field of Search ..... 15/42–48, 15/144 R, 144 A, 172, 229 B, 229 BC, 229 BC; 16/112, 116, 123; 403/152

[56] References Cited

U.S. PATENT DOCUMENTS

| | | | |
|---|---|---|---|
| 822,708 | 6/1906 | Wright | 403/152 |
| 1,632,481 | 6/1927 | Judge | 15/144 R |
| 3,268,936 | 8/1966 | Fukuba | 15/42 |
| 3,339,220 | 9/1967 | Barry | 15/144 A |
| 3,800,351 | 4/1974 | Fukuba | 15/144 R |

FOREIGN PATENT DOCUMENTS

| | | | |
|---|---|---|---|
| 950320 | 10/1956 | Fed. Rep. of Germany | 15/144 R |
| 1116352 | 11/1961 | Fed. Rep. of Germany | 15/144 R |
| 426061 | 10/1947 | Italy | 15/144 A |
| 442645 | 1/1968 | Switzerland | 15/144 R |
| 256841 | 8/1926 | United Kingdom | 15/229 B |

*Primary Examiner*—Daniel Blum

*Attorney, Agent, or Firm*—Wenderoth, Lind & Ponack

[57] ABSTRACT

A floor sweeper having an improved pivotal means for a handle is disclosed. The pivotal means comprises a main body having a concave portion thereon, a holding member having bearing apertures and a leaf spring positioned in a predetermined seat of the concave portion of the main body, wherein the handle is pivotally supported to swing in a desired angle such that shaft members of the handle are received in the bearing apertures of the holding member and base end of the handle is pressed upward by the leaf spring.

3 Claims, 4 Drawing Figures

FLOOR SWEEPER HAVING A PIVOTABLE HANDLE

BACKGROUND OF THE INVENTION

This invention relates to a floor sweeper and more particularly to a floor sweeper having an improved pivotal means for a handle.

Heretofore, there has been used a floor sweeper which comprises a main body adapted to run forward and backward on a floor. A rotary brush is installed under the main body, and a dust receptacle is provided for collecting dust wiped up by the rotary brush. A handle is further provided for operating the floor sweeper. In this floor sweeper, the handle must be pivoted to swing in the range of 90 to 180 degrees with respect to the top surface of the main body so that it can be freely moved at its pivoted point in a desired angle in accordance with a place to be swept. For this reason, the base portion of the handle is desired to be supported pivotally in the center of the top surface of the main body. However, such a pivotal construction in the prior art is constituted of a fixing means having a bearing member, for instance, welded to the main body. Therefore, the assembling steps thereof are very complicated and increased in number so that the price of the floor sweeper gets expensive. In addition, when the handle or pivotal construction thereof is accidentally broken, the replacement thereof is impossible due to its welded construction.

Further, the floor sweeper has a pivotal member for the handle which projects out of both sides of the main body. Therefore, the projected portion of the pivotal member is a hindrance when sweeping a corner portion or edge of a floor near a wall.

SUMMARY OF THE PRESENT INVENTION

Accordingly, it is an object of the present invention to provide a floor sweeper wherein fewer parts are necessary to assemble a pivot arrangement for a handle.

It is another object of the present invention to provide a floor sweeper wherein the assembly thereof is very easy and the price thereof is not expensive.

It is a further object of the present invention to provide a floor sweeper wherein a handle or other parts of the pivot arangement can be easily replaced by new ones.

According to the present invention, there is provided a floor sweeper having an improved pivot arrangement for a handle. The pivot arrangement has a main body formed with a concave portion in the center of the top surface thereof; a holding member with bearing apertures for shaft members projected at both sides of the base end of the handle; and a leaf spring positioned in a predetermined seat of said concave portion of the main body. The handle is pivotally supported to swing in a desired angle such that the shaft members of the handle are received in the bearing apertures of the holding member mechanically fixed to the main body and the base end of the handle is pressed upward by the leaf spring.

In a preferred embodiment of the present invention, the holding member is formed with lugs and threaded holes at both ends respectively, so that the lugs are inserted into slits of the main body, and fixing screws are passed through the threaded holes to provide a mechanical fixing between the holding member and the main body.

In another embodiment of the present invention, the holding member is shaped to have a forked end at which opposite, inside semicircular bearing apertures are formed with an open lower portion.

BRIEF DESCRIPTION OF THE DRAWINGS

These and other objects of the present invention will be seen by reference to the description, taken in connection with the accompanying drawings, in which.

DETAILED DESCRIPTION OF THE PREFERRED EMBODIMENTS

Figure 1:
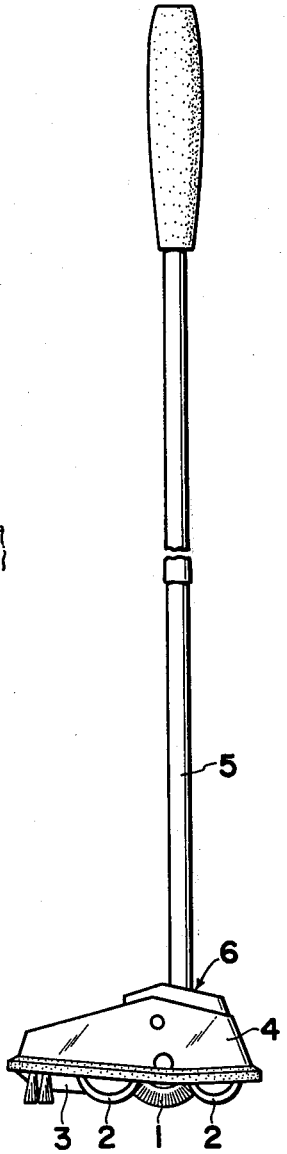
FIG. 1 is a side view illustrating a floor sweeper in a preferred embodiment according to the present invention.

In FIG. 1, there is shown a floor sweeper in a preferred embodiment according to the present invention. The floor sweeper comprises a main body 4, a handle 5 and an improved pivot arrangement 6 for the handle 5. Thereunder are installed a rotary brush 1, a pair of driver rollers 2 and a dust receptacle 3. The rotary brush 1 is driven in the direction opposite to the moving direction of the floor sweeper by contact with the drive rollers 2. Dust is collected into the dust receptacle 3 after being wiped off by the rotary brush 1. The handle 5 is adapted to swing by the construction of the handle pivot arrangement 6 installed in the center of the top surface of the main body 4.

Figure 2:
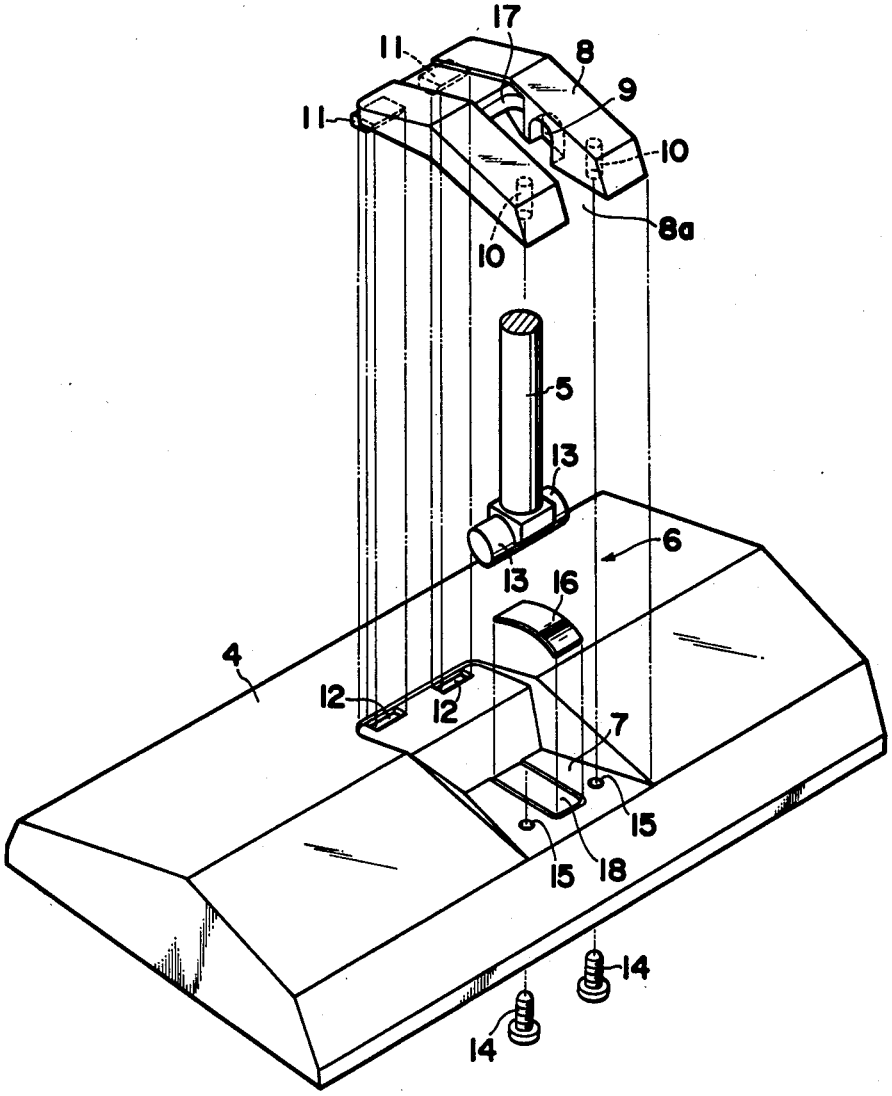
FIG. 2 is an exploded view illustrating an improved pivot arrangement for a handle in a preferred embodiment according to the present invention.
Figure 4:
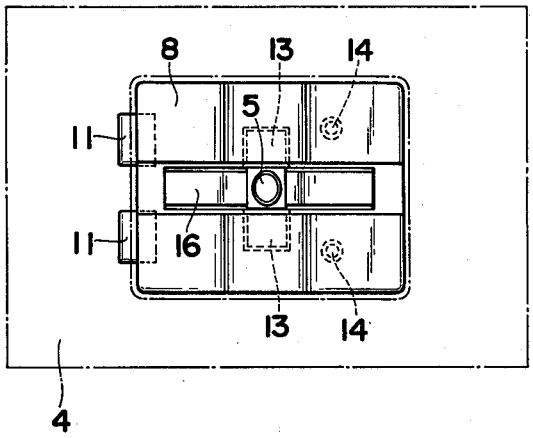
FIG. 4 is a top view of FIG. 3.

In FIG. 2, there is shown the improved pivot arrangement for the handle in its exploded condition. The main body 4 is formed with a concave portion 7 in the center of the top surface thereof and thereinto is inserted a holding member 8.

The holding member 8 is shaped to have a forked end 8*a*. A pair of bearing apertures 9 are positioned opposite each other inside the forked end 8*a* and two screw holes 10 ar formed respectively in the two leg portions of the forked end 8*a*.

At the upper side of the holding member 8 a pair of lugs 11 project which are respectively inserted into slits 12 in the main body 4.

At the base end of a handle 5 are shaft members 13 orthogonal to the axis of the handle 5. The shaft members 13 engage the bearing apertures 9 respectively, each bearing-aperture being a semicircle having an open lower portion.

At the concave portion 7 of the main body 4 are inserting holes 15 for fixing screws which correspond to the threaded holes 10 of the holding member 8. In a seat 18 on the concave portion 7 of the main body 4 is a leaf spring 16 which offers resistance to the handle 5. The seat 18 is of a shallow concave portion and prevents the leaf spring 16 from moving or dropping down therefrom. The leaf spring 16 works to give elastic force to the lower end of the shaft members 13 so that the handle 5 can be supported to stand up on the main body 4 due to the braking friction moment resisting the motion of the handle 5 with respect to the angular change in the moving direction of a floor sweeper.

In assembly, the leaf spring 16 is first placed into the seat 18 of the main body 4 and the holding member 8 is then put into the concave portion 7 of the main body 4 by inserting the lugs 11 of the former into the slits 12 of the latter along with the handle 5 having the shaft member 5 positioned in the bearing apertures 9 thereof. The handle 5 gets in contact at its base end with the leaf spring 16. Finally, the holding member 8 is connected with the main body 4 by having the fixing screws 14 inserted through the inserting holes 15 and the threaded holes 10. Accordingly, the handle 5 is pivotally supported to swing between the two leg portions of the forked end 8*a* of the holding member 8. In this embodiment, however, the handle 5 cannot swing beyond a touching portion 17 of the holding member 8 in the forward direction of a floor sweeper as clearly shown in FIG. 2.

Figure 3:
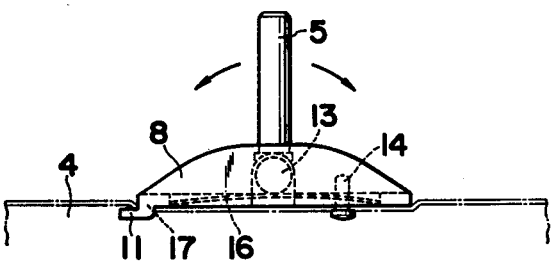
FIG. 3 is a partial side view illustrating an improved pivot arrangement for a handle in another preferred embodiment according to the present invention.

In FIG. 3, another embodiment according to the present invention is shown. A holding member 8 is connected to a main body with lugs 11 inserted into corresponding slits in the body and fixing screws 14 are threaded therethrough. A handle 5 is pivotally supported with shaft members 13 positioned in the holding member 8 and a leaf spring 16 is inserted in the holding member to resist the base end thereof in the same manner as illustrated in FIG. 2. In this embodiment, it should be noted that the handle 5 can swing in the range of 0 to 180 degrees in both of the forward and backward directions of a floor sweeper due to the construction of the holding member 8 wherein a touching portion 17 thereof is lowered in its height.

As described above in detail, fewer parts are necessary and the troublesome steps such as welding process are eliminated to provide a floor sweeper having an improved pivot arrangement for its handle according to the present invention due to the construction thereof wherein the pivot arrangement includes a main body formed with a concave portion in the center of the top surface thereof; a holding member formed with bearing apertures for shaft members projected at both sides of the base end of the handle; and a leaf spring positioned in a predetermined seat in the concave portion of the main body. The handle is pivotally supported to swing in a desired angle such that the shaft members of the handle are received in the bearing apertures of the holding member mechanically fixed to the main body and the base end of the handle is pressed upward by the leaf spring. Accordingly, the price of the product is lowered extensively compared to the prior art because it can be assembled only by simple assembling steps. Furthermore, parts can be easily replaced by new ones when they are broken because the disassembling of the improved pivotal means in the present invention can be easily accomplished by removing the fixing screws for the holding member. In addition, the handle is always supported to stand up even in its idle condition because the leaf spring offers elastic force against the base end thereof.

Although the invention has been described in its preferred form with a certain degree of particularity, it is understood that the present disclosure of the preferred form may be changed in the details of construction and the combination and arrangement of parts may be changed to without departing from the spirit and the scope of the invention as hereinafter claimed.

What I claim is:

1. An improved pivot arrangement for a handle of a rotary floor sweeper comprising:

a main body portion of said sweeper having a first concave portion in the center of the top thereof;

a handle member and two shaft members at the base of said handle member projecting orthogonal to the axis of said handle member;

holding member means removably fitted into said first concave portion of said main body and fitted around said shaft members on said handle for pivotally affixing said handle to said main body;

said main body having a second concave portion beneath said handle member held in said first concave portion by said holding member means; and a leaf spring means removably fitted into said second concave portion and biased toward and engaging said handle member for tightly holding said handle member in said holding member means.

2. an improved pivot arrangement as claimed in claim 1, where in said holding member means has lugs extending from one end thereof inserted into slits formed in said main body portion; and fixing screws are screwed through said main body portion into said holding member means.

3. An improved pivot arrangement for a handle of a rotary floor sweeper comprising:

a main body portion of said sweeper having a concave portion in the center of the top thereof;

a handle member and two shaft members at the base of said handle member projecting orthogonal to the axis of said handle member;

holding member means removably secured and fitted into said concave portion of said main body and fitted around said shaft members on said handle for pivotally affixing said handle member to said main body portion; and leaf spring means removably fitted into the bottom of said holding member means and biased toward and engaging said handle member in said holding member means for tightly holding said handle member therein.

* * * * *